United States Patent [19]

Comberg et al.

[11] 4,357,367

[45] Nov. 2, 1982

[54] METHOD OF BLACKENING STEEL COMPONENTS FOR CATHODE RAY TUBES

[75] Inventors: Albert Comberg; Karl H. Panstruga, both of Aachen, Fed. Rep. of Germany

[73] Assignee: U.S. Philips Corporation, New York, N.Y.

[21] Appl. No.: 245,839

[22] Filed: Mar. 20, 1981

[30] Foreign Application Priority Data

Mar. 21, 1980 [DE] Fed. Rep. of Germany ..... 3010855

[51] Int. Cl.[3] ..... C23C 3/00; C23F 5/00

[52] U.S. Cl. ..... 427/64; 148/6.3; 427/160; 427/383.7; 427/436; 427/437

[58] Field of Search ..... 148/6.3; 427/64, 160, 427/436, 437, 383.7

[56] References Cited

U.S. PATENT DOCUMENTS 3,562,518 2/1971 Javorik ..... 427/64

3,615,892 10/1971 Heinzelman ..... 148/6.2

FOREIGN PATENT DOCUMENTS 637457 12/1978 U.S.S.R. ..... 427/436

OTHER PUBLICATIONS

Fishlock, "Metal Colouring", Robert Draper Ltd., 1962, pp. 197–198; 280–281.

*Primary Examiner*—John D. Smith

*Attorney, Agent, or Firm*—Joseph P. Abate

[57] ABSTRACT

An adhering bismuth layer is provided on steel components for cathode ray tubes by electroless plating in an acidic aqueous solution of bismuth oxynitrate. The bismuth coated steel components are heated in an oxidizing atmosphere, for example in air, at temperatures between 350° C. and 650° C. until the bismuth coating becomes black.

4 Claims, No Drawings

METHOD OF BLACKENING STEEL COMPONENTS FOR CATHODE RAY TUBES

BACKGROUND OF THE INVENTION

The invention relates to a method of blackening steel components, particularly, for cathode ray tubes. Examples of such components include shadow masks and shadow mask frames.

It is known from *Valvo Berichte* XVIII, 1/2 (1974) 84–87 that impinging electrons heat the shadow mask of color display tubes. An undesired spontaneous local expansion of the mask is often associated with the heating. This leads to so-called landing errors. These landing errors result in color defects since the electron beams no longer impinge upon the luminescent elements associated with them. Therefore, it is generally desired to keep the temperature of the mask low and as spatially constant as possible.

Several methods are known to keep the surface of the shadow mask cool. According to the above-mentioned *Valvo Berichte,* a mask is blackened by oxidation of its surface in an oxidation furnace. A black iron oxide is formed at the mask surface. Because of this blackening, effective radiation of the thermal energy produced by electron bombardment must be accomplished. This method has several disadvantages. The thermal emission power of such black layers depends upon the composition of the iron oxide formed which, in certain circumstances, may also become brown. Further, iron oxide in a vacuum tends to deteriorate under heating by electron bombardment. Both effects lead to a decrease of the thermal emission power. Finally, the iron oxide layers are heated by absorbing the electrons and their energy.

Providing blacker and simultaneously heat-withstanding layers on the mask surface is known from U.S. Pat. No. 3,867,207, which uses an electroless plating bath containing nickel compounds or cobalt compounds. The layer formed is subjected to a strong oxidation acid and then fired in air at approximately 450° C. A disadvantage of the layers manufactured according to this method is that they also absorb the electrons and their energy. In addition, known plating baths comprise substances which are detrimental to health or even carcinogenic.

A mask coated with bismuth to reduce the passage of X-rays through the glass envelope of a color display tube is disclosed in U.S. Pat. No. 3,562,518. Blackening of the bismuth layer is not suggested. Also, it is not stated how the bismuth is provided on the shadow mask. According to *Ullmanns Encyklopadie der technischen Chemie* (Ullmann's Enyclopedia of Technical Chemistry), 3rd edition, vol. 18 (Munich-Berlin-Vienna 1967) p. 640, a bismuth coating can be provided on metallic articles by electrolysis, vapor deposition and electrodeposition. However, these methods have several disadvantages. For example, vapor deposition processes are technically expensive and require high investment while electrodeposition requires much energy and pollutes the environment.

SUMMARY OF THE INVENTION

It is therefore an object of the invention to provide a method of blackening steel components without the disadvantages of the known methods. In particular, a high thermal emission power of the shadow mask surface in the overall infrared wavelength range from one to 30 μm and, simultaneously, a high electron reflection power are achieved. Furthermore, the present method may be practiced with a simple process control.

According to the invention, this object is achieved in the following manner. An adhering bismuth layer is provided on the steel components by electroless plating in a bismuth salt dispersion or bismuth salt solution. The bismuth coated steel components are then heated in an oxidizing atmosphere, for example in air, at temperatures between 350° C. and 650° C. until a black layer is formed on the surface of the bismuth coated part.

The electroless plating is preferably performed in an acid medium while adding a surface active agent.

Examples of acid media include dilute sulphuric acid, tartaric acid solution and oxalic acid solution, in particular, in water.

Examples of surface active agents include commercially available dish washing detergents, in particular, those containing alkylpolyglycolether sulphates and alkylbenzene sulphonates in addition to non-ionic surface active agents.

The invention will now be described with reference to an example.

A plating bath is obtained by stirring three grams of bismuth oxynitrate and 10 grams of tartaric acid into one liter of water. During continued stirring, one gram of a dish washing detergent is then added. A dish washing detergent commercially available under the trademark "Pril" may be used. Cleaned and degreased steel components are then immersed in the liquid bath. After approximately 15 minutes, an adhering bismuth layer has deposited on the surface of the steel components. By heating and moving the plating bath, the bismuth deposition rate can be increased. After rinsing with water and drying, the coated parts are heated in air at 460° C. for one hour.

This method produces a homogeneous, adhering blackening of the surface which has a very high emission power in the infrared wavelength range from one to 30 μm. Further, the surface is stable against electron bombardment up to 50 kV in a vacuum and, because of the high atomic number of bismuth ($Z=83$), has an extremely high electron reflection power. Compared with usual iron oxide layers, increases of approximately 20% in the thermal emision power ($3<\lambda<30$ μm) and approximately 30% in electron reflection at a 25 kV acceleration voltage are gained with bismuth black layers prepared according to the invention.

What is claimed is:

1. A method of providing a black coating on a cleaned and degreased steel component for use in a cathode ray tube, which method comprises:

providing an electroless plating bath consisting essentially of an acidic aqueous solution of bismuth oxynitrate;

immersing the steel component in said plating bath for a time sufficient to coat the surface of the component with an adhering bismuth layer; and heating said bismuth coated component in an oxidizing atmosphere at a temperature between 350° C. and 650° C. until the bismuth coating becomes black.

2. A method as claimed in claim 1, wherein a surface active agent is present in the plating bath.

3. A method as claimed in claim 2, characterized in that the surface active agent is a non-ionic agent.

4. A method as claimed in claim 2, characterized in that the surface active agent is an anionic agent selected from the group consisting of the alkylpolyglycolether sulphates and the alklbenzene sulphonates.

* * * * *